US007883092B2

(12) United States Patent
Stephens et al.

(10) Patent No.: US 7,883,092 B2
(45) Date of Patent: Feb. 8, 2011

(54) ENERGY CURED COATING

(75) Inventors: Kenneth A. Stephens, Alpharetta, GA (US); Andrew W. Killian, Duluth, GA (US)

(73) Assignee: Scientific Games International, Inc., Newark, DE (US)

( * ) Notice: Subject to any disclaimer, the term of this patent is extended or adjusted under 35 U.S.C. 154(b) by 197 days.

(21) Appl. No.: 11/967,348

(22) Filed: Dec. 31, 2007

(65) Prior Publication Data

US 2009/0166968 A1 Jul. 2, 2009

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS 2,585,448 A * 2/1952 Emerson et al. ..... 106/316
4,174,857 A * 11/1979 Koza ..... 283/101
4,251,422 A * 2/1981 Hertler ..... 524/555
4,273,362 A * 6/1981 Carrier et al. ..... 283/95
4,591,190 A * 5/1986 Clark ..... 283/102
4,725,079 A * 2/1988 Koza et al. ..... 283/73
4,726,608 A * 2/1988 Walton ..... 283/96
5,074,566 A 12/1991 Desbiens
5,215,576 A 6/1993 Carrick
5,346,258 A * 9/1994 Behm et al. ..... 283/102
5,431,452 A 7/1995 Chang et al.
5,544,881 A 8/1996 Rua, Jr. et al.
5,641,167 A 6/1997 Behm et al.
5,925,440 A 7/1999 Farag et al.
5,997,044 A * 12/1999 Behm et al. ..... 283/83
6,076,860 A 6/2000 Holman et al.
6,076,866 A * 6/2000 Prevot et al. ..... 292/140
6,106,932 A 8/2000 Carides et al.
6,160,046 A 12/2000 Bleikolm et al.
6,368,682 B1 4/2002 Fong
6,379,742 B1 * 4/2002 Behm et al. ..... 427/7
6,435,408 B1 * 8/2002 Irwin et al. ..... 235/441
6,497,759 B1 12/2002 Yoshimura et al.
6,875,105 B1 * 4/2005 Behm et al. ..... 463/17
6,939,627 B2 9/2005 Morizumi et al.
7,029,754 B2 4/2006 Yamamoto et al.
7,375,144 B2 * 5/2008 Gilmer ..... 522/92
2005/0230960 A1 10/2005 Bilodeau et al.
2006/0006639 A1 1/2006 Taylor et al.
2006/0047014 A1 3/2006 Hopper et al.
2006/0162860 A1 7/2006 Henke et al.
2006/0165997 A1 * 7/2006 Tevis et al. ..... 428/411.1
2006/0238853 A1 10/2006 Morimoto et al.
2007/0164559 A1 7/2007 Kozdras

OTHER PUBLICATIONS

PCT Search Report, May 8, 2009.

* cited by examiner

*Primary Examiner*—Alvin A Hunter
*Assistant Examiner*—Dolores Collins
(74) *Attorney, Agent, or Firm*—Dority & Manning, P.A.

(57) ABSTRACT

An energy cured coating is described that may be used in numerous applications. In one embodiment, for instance, the coating can be used as a seal coat layer in a gaming card. In particular, the coating can be used to protect a hidden printed layer that is covered by a scratch-off material. In accordance with the present disclosure, the cured coating contains at least one monomer or oligomer in combination with a reactive plasticizer. The plasticizer may comprise one or more benzoates.

13 Claims, 1 Drawing Sheet

ENERGY CURED COATING

BACKGROUND

Game cards, such as lottery tickets, promotional game cards, and coupons, can, in some embodiments, contain hidden play indicia such as numbers, symbols or messages that indicate whether or not the card is a winner or has certain value to the holder. The play indicia is normally covered by an opaque coating material which can contain, for instance, metal particles, that can be scratched off by the holder to reveal the play indicia after the card or coupon has been purchased or otherwise obtained. Examples of various cards as described above are disclosed, for instance, in U.S. Pat. Nos. 4,174,857, 4,273,362, 4,299,637, 4,725,079, 4,726,608, 5,346,258, 6,076,860, and U.S. Patent Application No. 2006/0165997, which are all incorporated herein by reference.

One important aspect of constructing game cards as described above is to ensure that the cards are not capable of being tampered with such that one would be able to identify the hidden indicia without removing the opaque coating that is to be scratched off. In this regard, in the past, energy-curable coatings have been applied to the game cards over the printed indicia. The energy-curable coatings have been incorporated into the cards in order to improve graphic adhesion, improve backside wick protection, and to improve resistance to image ink alteration and migration.

Although these coatings have been very useful in the past, further improvements are needed. In this regard, an improved energy curable coating is needed that can provide better chemical barrier resistance. Energy curable coatings are also needed that are less expensive to produce and manufacture. Such coatings may have application not only in the production of gaming cards but also in the production of other products.

SUMMARY

In general, the present disclosure is directed to an energy cured coating that can be used, for instance, as a seal coat layer in a gaming card. As used herein, a "gaming card" is intended to include all different types of lottery tickets, gaming tickets, coupons, promotional cards, novelty cards, and the like. The energy cured coating of the present disclosure contains at least one crosslinked monomer or oligomer in combination with one or more plasticizers. As will be described in greater detail below, the energy cured coating is flexible and has good chemical barrier properties. Energy cured coatings can be made according to the present disclosure that have little or no cracks or small fissures.

In one embodiment, for instance, the present disclosure is directed to a coated substrate, such as a gaming card, comprising a substrate, a printed layer containing printed indicia, and an opaque scratch-off layer positioned over the printed layer. The gaming card can further include a seal coat layer positioned in between the printed layer and the opaque scratch-off layer. The seal coat layer comprises an energy cured coating containing at least one crosslinked monomer or oligomer and a plasticizer. In accordance with the present disclosure, the plasticizer can comprise a benzoate.

For instance, in one embodiment, the plasticizer may comprise one or more alkylene glycol benzoates. Such benzoates can include, for instance, dipropylene glycol benzoate, diethylene glycol benzoate, or mixtures thereof. The plasticizer can be present in the energy cured coating in an amount from about 1% to about 40% by weight, such as from about 15% to about 40% by weight. The plasticizer, in one embodiment, can actually react with the one or more crosslinked monomers or oligomers present in the coating during curing.

The energy used to cure the coating can, in one embodiment, comprise an electron beam. In general, any suitable monomer or oligomer capable of crosslinking during curing may be used to form the seal coat layer. The monomer or oligomer, for instance, may comprise bisphenol-A epoxy diacrylate, a polyester acrylate, a urethane acrylate, an aliphatic acrylate, an acrylated epoxy, or mixtures thereof. The crosslinked monomers or oligomers may be present in the cured coating in a total amount of from about 15% to about 60% by weight.

In addition to one or more crosslinked monomers or oligomers and a plasticizer, the seal coat layer may also contain a reactive diluent and/or a polymerization inhibitor. Reactive diluents that may be used include tripropylene glycol diacrylate, an ethoxylated trimethyl propylene triacrylate, or mixtures thereof.

The reactive diluent can be present in the cured coating in an amount from about 20% to about 75% by weight.

One embodiment of a polymerization inhibitor that may be used in the seal coat layer comprises hydroquinone monomethyl ether. The polymerization inhibitor can be present in an amount less than about 1% by weight, such as in an amount less than about 0.5% by weight.

In addition to a printed layer, a seal coat layer, and an opaque scratch-off layer, the gaming card may also include various other coatings. For instance, in one embodiment, a primer coating may be applied to the substrate that receives the printed layer. The gaming card may also include a release coating positioned in between the seal coat layer and the opaque scratch-off layer.

It should also be understood that each functional layer on the gaming card can comprise one or more coatings. For instance, the gaming card may include a plurality of seal coat layers. Similarly, the opaque scratch-off layer can comprise multiple coatings.

Other features and aspects of the present disclosure will be discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
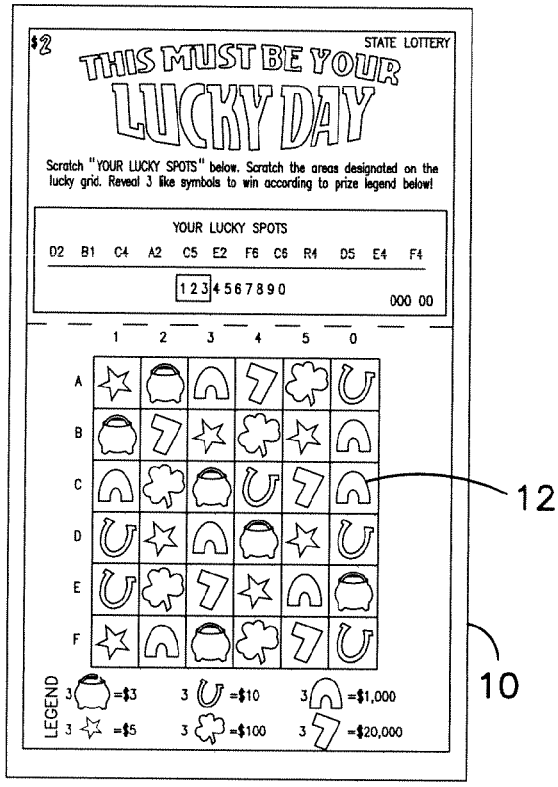
FIG. 1 is a perspective view of one embodiment of a gaming card that may be made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to an energy cured coating and to a process of making the coating. In one embodiment, for instance, the coating can be cured using electron beam radiation. The coating can be used to coat any suitable substrate. In one embodiment, the energy cured coating is formulated to have enhanced flexibility and improved chemical resistance. In accordance with the present disclosure, the energy cured coating is formed from at least one crosslinked monomer or oligomer in combination with a plasticizer. The plasticizer, which can chemically react with the other components in the coating, improves flexibility and reduces cracks and fissures that may be found in comparable coatings. The reduction of cracks and fissures leads to improved chemical barrier properties.

In one embodiment, the energy cured coating of the present disclosure can be used to construct a gaming card. The energy cured coating, for instance, may be used to protect printed indicia on the card. For instance, the cured coating can improve graphic adhesion, improve backside wick protection, and improve the resistance of the card to image ink alteration or image ink migration by thermal or chemical means. Examples of gaming cards that can be constructed in accordance with the present disclosure include lottery tickets, phone cards, promotional games, coupons, and the like. In one embodiment, for instance, the cured coating of the present disclosure may be used to cover printed indicia on the card and may be positioned in between the printed indicia and a scratch-off or scratch-off layer.

Figure 2:
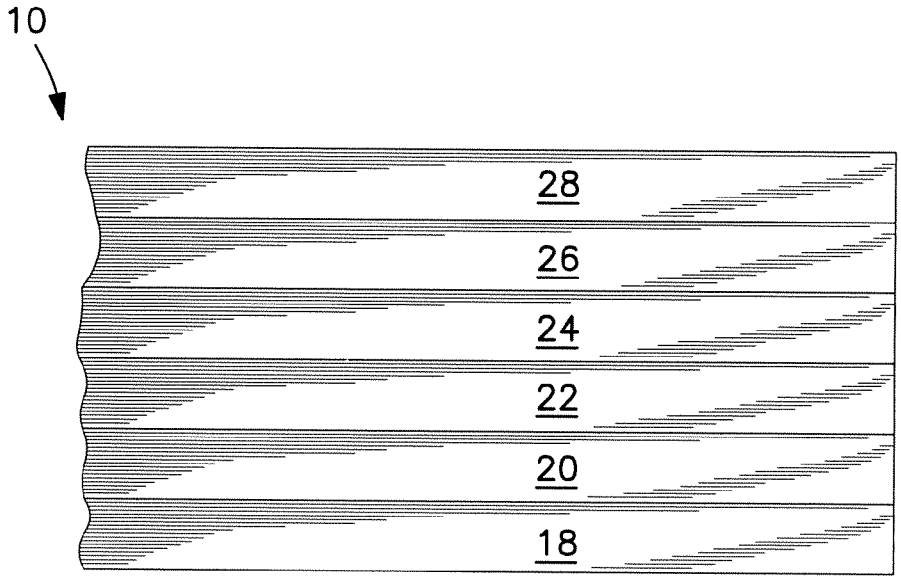
FIG. 2 is a side view of one embodiment of the gaming card illustrated in FIG. 1.

For instance, referring to FIGS. 1 and 2, one embodiment of a gaming card 10 in accordance with the present disclosure is illustrated. The gaming card 10 as shown in FIG. 1 merely represents one exemplary embodiment of a product made in accordance with the present disclosure. It should be appreciated that the cured coating as will be described in greater detail below may be incorporated into numerous products including other forms of gaming cards.

As illustrated, the gaming card 10 includes a scratch-off area 12 that covers hidden printed indicia. The hidden printed indicia may comprise characters or numbers that, when exposed, indicates whether the holder of the gaming card is a winner or a loser.

In the illustrated embodiment, the gaming card 10 in the scratch-off area 12 is comprised of different layers of materials. A cross section of the gaming card 10 showing the different layers of materials is illustrated in FIG. 2. In this embodiment, the layers include a substrate 18, an optional primer coating 20, a printed layer 22, a seal coat layer 24 made in accordance with the present disclosure, a optional release coating 26, and a scratch-off layer 28. It should be understood, however, that more or less layers may be contained in the gaming card 10. For instance, in one embodiment, a foil layer made of, for instance, aluminum foil, may be adhered directed to the substrate 18. In addition, a further printed layer may be applied to the top surface of the scratch-off layer 28. Further, each layer may comprise multiple coatings. For instance, the seal coat layer 24 can be made from multiple coatings of the same or similar material. In addition, the scratch-off layer 28 can be comprised of multiple coatings.

The substrate 18 can be made of any suitable material. For instance, the substrate 18 can be made from paper, cardboard, paperboard, or a polymer film, such as a polyester film.

The primer coating 20 is optionally present in order to provide a suitable surface for printing. Thus, the primer coating 20 can be made from any suitable print receptive material. A primer coating 20 may be needed, for instance, when a foil layer has been adhered to the substrate 18. In one embodiment, for instance, the primer coating 20 can contain silica particles contained in a polymeric binder. The binder may comprise, for instance, an acetate copolymer, such as a copolymer of maleic acid and vinyl acetate.

The printed layer 22 contains printed indicia that is hidden by the scratch-off layer until the scratch-off layer is removed. The printed layer may comprise, for instance, designs, symbols or alphanumeric indicia. The printed layer 22 can be applied to the substrate 18 using any suitable printing method. In one embodiment, for instance, the printed layer 22 is applied using an inkjet printer, such as a drop on demand or continuous inkjet printer.

Any suitable ink can be used to form the printed layer. In one embodiment, for instance, the ink may be water soluble. In still another embodiment, an ink may be used that is energy curable. When the ink used to form the printed layer 22 is energy curable, for instance, it may be crosslinked or reacted with the seal coat layer 24. The ink used can be most any color. Inks that may be used are disclosed, for instance, in U.S. Pat. Nos. 6,310,115 and 6,156,110, which are incorporated herein by reference.

Covering the printed layer 22 is the seal coat layer 24 made in accordance with the present disclosure. The seal coat layer 24 protects the printed layer 22 from liquids in which the ink is soluble. In accordance with the present disclosure, the seal coat layer 24 is energy cured using, for instance, electron beam radiation.

In the embodiment illustrated, the seal coat layer 24 is positioned over the printed layer 22. In an alternative embodiment, the gaming card 10 can include a second seal coat layer positioned in between the substrate 18 and the printed layer 22.

The seal coat layer 24, in one embodiment, can act as a release layer for the scratch-off layer 28. Alternatively, however, a release coating 26 may be positioned in between the seal coat layer 24 and the scratch-off layer 28. When present, the release coating 26 provides a non-bonding interface for the scratch-off layer 28. Any type of release coating that provides the desired effects can be utilized. In one embodiment, the release coating can comprise a resin material, metallic soap, and optionally an anti-static material. The resin material may comprise, for instance, a polyamide resin, a wax-like resin, or a silicone resin.

The scratch-off layer 28 is generally made from a material that can be removed from the release coating 26 or the seal coat layer 24 and is opaque for visually hiding the printed layer 22. In one embodiment, the scratch-off layer 28 may be formed from an elastomeric substance, such as a latex. In one embodiment, the scratch-off layer may comprise a binder, such as a latex, that contains metal particles, such as powdered aluminum.

In one particular embodiment, for instance, the scratch-off layer may comprise one or more block copolymers combined with aluminum powder and carbon black powder. The block copolymer may comprise, for instance, a block copolymer containing polystyrene, such as an S-EB-S block copolymer, an S-I-S block copolymer, or a polybutadiene.

The present disclosure is generally directed to the seal coat layer 24 that is positioned between the printed layer 22 and the scratch-off layer 28. The seal coat layer 24 can, for instance, comprise in one embodiment a cured coating containing at least one crosslinked monomer or oligomer and a plasticizer, particularly a reactive plasticizer that can react with the at least one crosslinked monomer or oligomer when cured. The plasticizer may comprise, for instance, a benzoate. For example, the plasticizer may comprise one or more alkylene glycol benzoates.

In one particular embodiment, for instance, the plasticizer comprises dipropylene glycol benzoate, diethylene glycol benzoate, or mixtures thereof. The plasticizer can be present in the cured coating in an amount from about 1% to about 40% by weight, such as from about 10% to about 40% by weight.

The present inventors have discovered that various benefits and advantages can be obtained by combining the plasticizer with at least one monomer or oligomer that is formed into a coating and cured using a suitable energy source, such as electron beam radiation. For example, the plasticizer can not only reduce the cost of the seal coat layer but can make the resulting coating more flexible and contains less cracks or small fissures. Ultimately, a coating can be produced that has improved chemical barrier properties. In addition, the presence of the plasticizer can also improve leveling and flowout of the composition during formation of the coating.

Benzoate plasticizers that may be used in the present disclosure are available from various commercial sources. In one embodiment, for instance, the benzoate can be obtained from Velsicol Chemical Corporation under the trade name BENZOFLEX 50.

The at least one monomer or oligomer combined with the plasticizer generally comprises any suitable monomer or oligomer capable of crosslinking or otherwise reacting when exposed to electron beam radiation. In one embodiment, for instance, the monomers and/or oligomers present in the composition include bisphenol-A epoxy diacrylate. Bisphenol-A epoxy diacrylate is the diacrylate ester of bisphenol-A epoxy resin. In one embodiment, the bisphenol-A epoxy diacrylate can be ethoxylated. Bisphenol-A epoxy diacrylate is available from various commercial sources. For instance, bisphenol-A epoxy diacrylate is sold under the trade name CN-104 from Sartomer Company and under the trade name EBECRYL 3720 by UCB Chemicals.

Various other monomers and oligomers may also be present in the coating composition. Examples of other monomers and/or oligomers that may be present include polyester acrylates, urethane acrylates, aliphatic triacrylates, monoacrylates, acrylate copolymers, cycloaliphatic diepoxides, and the like. Particular monomers that may be used include, for instance, 2-hydroxy-3-phenoxy propyl acrylate and diurethandimetyl acrylate. Such monomers and oligomers are commercially available from various sources. An example of a monoacrylate, for instance, is sold under the trade name PHOTOMER 4703 by the Cognis Corporation. One example of a multi-functional polyester acrylate that may be used is sold under the trade name EBECRYL 810 by UCB Chemicals. An aromatic urethane diacrylate that may be incorporated into the coating is sold under the trade name EBECRYL 4827 by UCB Chemicals. A commercially available acrylate copolymer that may be incorporated in the composition is sold under the trade name BYK-361 N by BYK Chemie. An aliphatic triacrylate oligomer that may be incorporated in the composition is commercially available under the trade name CN 133 by the Sartomer Corporation.

The total amount of monomers or oligomers present in the composition that crosslink and react when exposed to an energy source can vary depending upon the particular application and the desired result. In general, the total amount of monomers and/or oligomers present in the composition can be from about 5% to about 80% by weight, such as from about 15% to about 60% by weight. In one embodiment, for instance, the only monomer or oligomer present in the composition comprises bisphenol-A epoxy diacrylate in an amount from about 10% to about 40% by weight, such as in an amount from about 10% to about 20% by weight.

In an alternative embodiment, bisphenol-A epoxy diacrylate may be combined with one or more other monomers or oilgomers. For instance, in one embodiment, bisphenol-A epoxy diacrylate may be present in the compostion in conjunction with 2-hydroxy-3-phenoxy propylacrylate and diurethane dimethylacrylate. In this embodiment, for instance, the bisphenol-A epoxy diacrylate may be present in an amount from about 10% to about 30% by weight, while the remaining monomers and oligomers may be present in an amount from about 10% to about 30% by weight, such as in an amount of about 20% by weight.

In still another embodiment, the composition used to form the seal coat layer can contain bisphenol-A epoxy diacrylate in an amount from about 5% to about 15% by weight, a polyester acrylate in an amount from about 5% to about 10% by weight, a urethane acrylate in an amount from about 5% to about 10% by weight, and an aliphatic triacrylate oligomer in an amount from about 10% to about 15% by weight.

In addition to one or more monomers or oligomers and the plasticizer, the composition used to form the seal coat layer can include various other ingredients and components. For example, in one embodiment, a diluent, and particularly a reactive diluent, is present. A diluent can be incorporated into the composition in order to adjust the viscosity of the composition so that the composition can be easily applied to the substrate. A reactive diluent is a diluent that reacts with at least one other component in the composition during curing, such as when being exposed to an electron beam. Examples of reactive diluents include tripropylene glycol diacrylate and/or an ethoxylated trimethyl propylene triacrylate. Reactive diluents as described above are commercially available from the Cognis Corporation or from the Sartomer Corporation under the trade names PHOTOMER 4061 and SR 306, respectively. When present, the reactive diluent can be contained within the composition in an amount from about 20% to about 75% by weight, such as from about 30% to about 70% by weight.

In addition to a reactive diluent, the composition can also contain a polymerization inhibitor. The polymerization inhibitor may be present in an amount less than 1% by weight, such as in an amount less than about 0.5% by weight. For instance, the polymerization inhibitor may be present in the composition in an amount from about 0.05% to about 0.15% by weight. An example of a polymerization inhibitor is hydroquinone monomethyl ether.

In addition, various slip agents and leveling agents may also be present in the composition. Such components are generally present in minor amounts, such as in an amount less than 5% by weight, such as in an amount less than about 2% by weight. Slip agents and leveling agents that are well suited for use in the seal coat layer include acrylate copolymers, such as a silicone acrylate copolymer.

The composition can also contain a defoamer. The defoamer may be present in an amount less than 3% by weight, such as in an amount of about 0.5% by weight. In one embodiment, the defoamer may comprise a polysiloxane.

Particular compositions that may be used to form the seal coat layer of the present disclosure are as follows. It should be understood, however, that the following formulations are merely exemplary.

| Ingredient | Formula 1 (weight percentage) | Formula 2 (weight percentage) | Formula 3 (weight percentage) | Formula 4 (weight percentage) |
|---|---|---|---|---|
| Tripropylene glycol diacrylate and/or an ethoxylated trimethypropylene triacrylate | 32.9 | 64.9 | 33.9 | 55.8 |

-continued

| Ingredient | Formula 1 (weight percentage) | Formula 2 (weight percentage) | Formula 3 (weight percentage) | Formula 4 (weight percentage) |
|---|---|---|---|---|
| Hydroquinone monomethyl ether | 0.1 | 0.1 | 0.1 | 0.45 |
| 1:1 mixture of diethylene glycol dibenzoate and dipropylene glycol dibenzoate | 20 | 20 | 20 | — |
| Bisphenol-A epoxy diacrylate | 25 | 15 | 25 | 8.56 |
| Mixture of 2-hydroxy-3-phenoxy propyl acrylate and diurethane dimethyl acrylate | 20 | — | 20 | — |
| Aliphatic triacrylate oligomer | — | — | — | 12.88 |
| Polyester acrylate | — | — | — | 8.56 |
| Urethane acrylate | — | — | — | 8.56 |
| Silicone acrylate copolymer | 1 | — | 1 | 0.2 |
| Polysiloxane | — | — | — | 0.5 |

In order to combine the above ingredients together in order to form the seal coat layer, all of the ingredients can be added to the reactive diluent during mixing. Once mixed together, the composition can then be added to the substrate using any suitable technique. Examples of techniques useful for applying the composition to the substrate include flexography, rotogravure printing, screen printing, offset printing, letter press coating or roll coating.

Once applied to the substrate, the coating is then subjected to an energy source which causes the coating to cure. For instance, in one embodiment, the coating can be subjected to electromagnetic radiation, such as electron beam radiation. Electron beam radiation, for instance, involves the production of accelerated electrons by an electron beam device.

When supplying electromagnetic radiation, it is generally desired to selectively control various parameters of the radiation to enhance the degree of crosslinking. For example, one parameter that may be controlled is the wavelength $\lambda$ of the electromagnetic radiation. Specifically, the wavelength $\lambda$ of the electromagnetic radiation varies for different types of radiation of the electromagnetic radiation spectrum. Although not required, the wavelength $\lambda$ of the electromagnetic radiation used in the present invention is generally about 1000 nanometers or less, in some embodiments about 100 nanometers or less, and in some embodiments, about 1 nanometer or less. Electron beam radiation, for instance, typically has a wavelength $\lambda$ of about 1 nanometer or less.

Besides selecting the particular wavelength $\lambda$ of the electromagnetic radiation, other parameters may also be selected to optimize the degree of crosslinking. For example, higher dosage and energy levels of radiation will typically result in a higher degree of crosslinking; however, it is generally desired that the materials not be "overexposed" to radiation. Such overexposure may result in an unwanted level of product degradation. Thus, in some embodiments, the total dosage employed (in one or multiple steps) may range from about 1 megarad (Mrad) to about 30 Mrads, in some embodiments, from about 1 Mrads to about 5 Mrads, and in some embodiments, from about 2.5 to about 3 Mrads. In addition, the energy level may range from about 75 KEV to about 200 KEV, such as about 125 KEV.

In addition to the above, oxygen levels may also be controlled during exposure to the electron beam radiation. For instance, oxygen levels can be maintained in the atmosphere below about 200 PPM, such as less than about 100 PPM.

Of particular advantage, curing can occur online with a printing press. Curing can occur, for instance, while the substrate is moving at a speed of from about 200 ft./min. to about 1200 ft./min.

Upon exposure to the energy source, the coating crosslinks forming a 3-dimensional network. As described above, the presence of the plasticizer can dramatically improve flexibility and decrease or inhibit the formation of cracks or fissures. The resulting seal coat has been found to have excellent chemical resistance properties.

The thickness of the coating can vary depending upon the particular application. The thickness can be, for instance, from about 0.1 mil to about 2 mil, such as from about 0.1 mil to about 0.7 mil.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A gaming card comprising:

a substrate;

a print layer comprising printed indicia;

a flexible seal coat layer covering the printed layer, the seal coat layer comprising an energy cured coating containing at least one crosslinked monomer or oligomer and a plasticizer, the plasticizer comprising an alkylene glycol benzoate, wherein the plasticizer is present in the seal coat layer in an amount from about 1% to about 40% by weight; and wherein the seal coat layer further comprises a reactive diluent comprising tripropylene glycol diacrylate, an ethoxylated trimethyl propylene triacrylate, or mixtures thereof; and an opaque scratch-off layer covering the seal coat layer.

2. A gaming card as defined in claim 1, wherein the plasticizer comprises a dipropylene glycol benzoate or a diethylene glycol benzoate.

3. A gaming card as defined in claim 1, wherein the plasticizer comprises a mixture of a dipropylene glycol benzoate and a diethylene glycol benzoate.

4. A gaming card as defined in claim 1, wherein the plasticizer is present in the seal coat layer in an amount from about 10% to about 40% by weight.

5. A gaming card as defined in claim 1, wherein the plasticizer has reacted with the crosslinked monomer or oligomer within the seal coat layer.

6. A gaming card as defined in claim 1, wherein the at least one crosslinked monomer or oligomer comprises bisphenol-A epoxy diacrylate.

7. A gaming card as defined in claim 1, wherein the at least one crosslinked monomer or oligomer comprises bisphenol-A epoxy diacrylate, a polyester acrylate, a urethane acrylate, an aliphatic acrylate, an acrylated epoxy, or mixtures thereof.

8. A gaming card as defined in claim 1, wherein the plasticizer is present in the seal coat layer in an amount from about 10% to about 40% by weight and wherein the total amount of crosslinked monomers or oligomers present in the seal coat layer is from about 15% to about 60% by weight and wherein the seal coat layer further comprises a reactive diluent in an amount from about 20% to about 70% by weight and a polymerization inhibitor.

9. A gaming card as defined in claim 8, wherein the at least one crosslinked monomer or oligomer comprises bisphenol-A epoxy diacrylate, a polyester acrylate, a urethane acrylate, an aliphatic acrylate, an acrylated epoxy, or mixtures thereof, the reactive diluent comprises tripropylene glycol diacrylate, an ethoxylated trimethyl propylene triacrylate, or mixtures thereof, and the polymerization inhibitor comprises hydroquinone monomethyl ether.

10. A gaming card as defined in claim 1, wherein the opaque scratch-off layer comprises a binder and metal particles.

11. A gaming card as defined in claim 1, wherein the gaming card further comprises a primer coating positioned in between a top surface of the substrate and the printed layer, the gaming card further including a release coating positioned in between the seal coat layer and the opaque, scratch-off layer.

12. A gaming card as defined in claim 1, wherein the gaming card includes a plurality of seal coat layers.

13. A gaming card as defined in claim 1, wherein the seal coat Layer has been energy cured by exposing the coating to an electron beam.

* * * * *